US009938481B2

(12) United States Patent
Moger

(10) Patent No.: US 9,938,481 B2
(45) Date of Patent: Apr. 10, 2018

(54) MIXTURE FOR FACILITATING LIGHTING OF FRIENDLY FIRES

(71) Applicant: Anthony C. Moger, Dundee, MN (US)

(72) Inventor: Anthony C. Moger, Dundee, MN (US)

( * ) Notice: Subject to any disclaimer, the term of this patent is extended or adjusted under 35 U.S.C. 154(b) by 0 days.

(21) Appl. No.: 15/043,650

(22) Filed: Feb. 15, 2016

(65) Prior Publication Data

US 2016/0237365 A1 Aug. 18, 2016

Related U.S. Application Data

(60) Provisional application No. 62/116,747, filed on Feb. 16, 2015.

(51) Int. Cl.

| | |
|---|---|
| ***C10L 11/00*** | (2006.01) |
| ***C10L 7/00*** | (2006.01) |
| ***C10L 7/02*** | (2006.01) |
| ***C10L 7/04*** | (2006.01) |
| ***C10L 11/04*** | (2006.01) |

(52) U.S. Cl.
CPC ..... *C10L 11/04* (2013.01); *C10L 7/02* (2013.01)

(58) Field of Classification Search
CPC .... C10L 11/04; C10L 7/02; C10L 2200/0453; C10L 2230/06; C10L 7/00; C10L 8/00; C10L 11/00; C10L 11/03; C10L 2200/0254; C10L 2290/22
See application file for complete search history.

(56) References Cited

U.S. PATENT DOCUMENTS

| | | | | |
|---|---|---|---|---|
| 3,072,467 | A * | 1/1963 | Wiczer | C10L 7/04 44/267 |
| 3,174,838 | A * | 3/1965 | Cruz, Jr. | C10L 5/40 44/267 |
| 3,613,658 | A | 10/1971 | Knowles | |
| 3,759,675 | A | 9/1973 | Lazarus et al. | |
| 4,043,765 | A * | 8/1977 | Tanner | C10L 5/44 44/519 |
| 4,485,584 | A | 12/1984 | Raulerson et al. | |
| 4,756,719 | A | 7/1988 | Saito | |
| 4,906,254 | A | 3/1990 | Antosko | |
| 5,967,769 | A | 10/1999 | Thompson | |
| 6,136,053 | A | 10/2000 | Sullivan | |
| 8,216,322 | B2 | 7/2012 | Schweickhardt | |
| 8,808,409 | B2 | 8/2014 | Banner et al. | |
| 2002/0129808 | A1 | 9/2002 | Manner | |
| 2011/0209392 | A1* | 9/2011 | Kunik | C04B 7/4407 44/500 |
| 2014/0283440 | A1* | 9/2014 | Beadles | C10L 5/146 44/522 |

* cited by examiner

*Primary Examiner* — Pamela H Weiss
(74) *Attorney, Agent, or Firm* — Nikolai & Mersereau, P.A.; Thomas J. Nikolai

(57) ABSTRACT

The flammable mixture dispensable from a squeeze tube for use in igniting friendly fires comprises grated paraffin wax impregnated with cotton fibers and blended with a quantity of diethyl ether sufficient to yield a material of a soft, gel-like consistency. Petroleum jelly and cooking oil may also be included in the mixture to tailor the consistency of the combination.

10 Claims, No Drawings

MIXTURE FOR FACILITATING LIGHTING OF FRIENDLY FIRES

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

This invention relates generally to camping equipment and, more particularly, to an easy-to-carry, easy and safely to apply, accelerant for igniting friendly fires such as campfires and logs in a home fireplace.

II. Discussion of the Prior Art

The prior art is replete with devices for aiding in igniting fires out-of-doors. For example, liquid petroleum-based accelerants such as kerosene, gasoline, diesel fuel, and the like, have been routinely used, but some of these, especially gasoline, are unsafe to use because of their volatility. Also, containers of such materials do not lend themselves to ready transport by hikers and campers.

The Thompson U.S. Pat. No. 5,967,769 and the Schweickhart U.S. Pat. No. 8,216,322 each disclose a non-combustible container in which a corrugated paper is rolled and the corrugations are filled with paraffin or a mixture of mineral spirits (turpentine) and paraffin such that when the container is opened and the contents easily ignited by a match, the unit can be placed beneath kindling and logs to provide a long burning source to ensure that the kindling and logs are set afire.

In another arrangement shown in the Banner et al U.S. Pat. No. 8,808,409, the camper carries a flammable liquid in a spray bottle along with a quantity of wood shavings, chips or pellets. When a campfire of logs and branches is to be started, the user must use the spray bottle to spray and saturate the wood shavings, chips or pellets, which are then ignited and overlayed with kindling material and logs. Inherent in this approach are problems of unintended spillage and the sheer bulk of the materials that make it impractical to transport when hiking and camping.

It is accordingly a principal object of the present invention to provide an accelerant for starting a campfire or logs in a fireplace that is of a gel-like consistency such that it can be squeezed from a compressible tube, much like toothpaste, and that is sufficiently tacky that is will adhere to kindling and/or logs to be ignited and that can be safely, yet readily ignited and will burn over a time sufficient to start split logs aflame.

SUMMARY OF THE INVENTION

In accordance with the present invention, there is provided a mixture of finely grated paraffin containing cotton fibers and that, when combined with ether, forms a gelatinous mixture that can be packaged in a suitable container, for example, a squeezable tube, much like a toothpaste tube, and sealed with a screw cap when not being used. At the time of use, the cap is removed and the aforementioned mixture can be squeezed from the tube onto kindling material and subsequently safely ignited without dangerous flaring.

In accordance with a further embodiment, petroleum jelly may be combined with the paraffin/cotton/ether mixture to add volume. Furthermore, cooking oil may be added to adjust the consistency of the mixture so that it is readily dispensed from a squeeze tube container or spread from a jar with a stick or paddle onto the material to be ignited.

DESCRIPTION OF THE PREFERRED EMBODIMENT

To assist in starting a campfire or a hearth fire, there is provided a thick gel-like substance that is squeezable from a collapsible tube and that when ignited, burns for an extended period of time, that is readily portable, inexpensive and safe to use.

By itself, the gel-like substance is clean burning, odorless when burning and when once ignited, it produces a steady flame approximately 4 to 5 inches in height.

To use my product, one simply makes a standard setup for a campfire or hearth fire. This would typically include a layer of suitable kindling placed below the wood logs intended to be burned. A desired amount of the starter gel will be squeezed out or otherwise applied to the kindling and then ignited with a match or lighter. The product, when formulated as indicated below, will ignite easily, but not explosively. The gel will steadily burn for a time sufficient to allow the kindling to ignite and subsequently the burning kindling will also ignite the logs or other wood used in establishing the campfire.

In formulating a batch of the gel, I take a block of paraffin wax of a given volume and an equal volume of cotton fibers and add the cotton fibers to the paraffin wax after the wax has been melted. Once the paraffin/cotton mixture has again solidified, I finely grate the cotton/paraffin block. Next, a quantity of the grated material is blended with diethyl ether in a ratio of about 100 grams of paraffin/cotton to 125 grams of diethyl ether, resulting in a mixture of a gel-like consistency. This mixture is then loaded into a squeezable dispensing tube and sealed therein by closing off the bottom end of the tube and capping the tube's outlet end.

Even though diethyl ether alone is very volatile and readily evaporates, when mixed with the paraffin/cotton particulate resulting from the grating operation, its volatility is greatly decreased allowing it to be stored in a sealed tube or other container for prolonged periods of time.

In an alternative embodiment, I have added to the paraffin/cotton/diethyl ether mixture petroleum jelly which is thoroughly blended with the cotton/paraffin/diethyl ether gel. I have found that about 2.5 grams of petroleum jelly can be added to a batch comprising 200 grams of the paraffin/cotton/diethyl ether mixture. To modify the consistency, a small percent by volume, typically 5%, of cooking oil may be added in creating a batch.

Tests have shown that a small dollop, about the size of a quarter dollar, will burn for more than 5 minutes, which is generally sufficiently long enough to ensure that kindling will ignite and, if in sufficient quantity, will cause dry logs to also take flame.

My product, when packaged in a standard, large-size toothpaste-type squeeze tube can readily be carried on a camping trip in one's pocket and, because of the consistency of the material, it can be easily squeezed by hand onto kindling and subsequently ignited to reliably start a campfire or other friendly fire.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices. Also, various modifications, both as to the equipment and operating procedures, can be accomplished without departing from the scope of the invention itself.

What is claimed is:

1. In combination, a flammable material for facilitating the lighting of fires comprising:

a) paraffin wax impregnated with cotton fibers and softened with diethyl ether to form a gelatinous mixture; and b) said mixture being contained in a squeeze tube package sealed by a removable cap and dispensable therefrom onto a material to be burned by manual compression of the package upon removal of the cap.

2. The flammable material as in claim 1 and further comprising an amount of petroleum jelly included in said mixture.

3. The flammable material as in claim 2 and further including an amount of a cooking oil included in said mixture.

4. The flammable material as in claim 1 wherein the quantity of paraffin wax impregnated with cotton fibers and the quantity of diethyl ether are in a ratio of 1:1.25 by weight.

5. The flammable material as in claim 4 and further including a quantity of petroleum jelly in a ratio of 25 parts by weight of petroleum jelly to 100 parts by weight of the paraffin wax impregnated with cotton fibers and diethyl ether mixture.

6. The flammable material as in claim 5 and further including cooking oil in combination with the paraffin wax impregnated with cotton fibers, diethyl ether and petroleum jelly mixture.

7. A method for producing and packaging a fire accelerant comprising the steps of:

a) melting a volume of paraffin wax;

b) mixing in an equal volume of cotton fibers to the melted paraffin wax and allowing the mixture to resolidfy;

c) grating the solidified mixtures of paraffin and cotton fibers;

d) blending the grated material of step c) with a predetermined volume of diethyl ether sufficient to produce a gel-like consistency; and e) filling one or more squeeze tube containers with the mixture of step d).

8. The method of claim 7 and before step e) adding a quantity of petroleum jelly to the mixture of step d).

9. The method of claim 8 wherein the petroleum jelly is added to the mixture in a ratio of 15 parts by weight of petroleum jelly to 100 parts by weight of the mixture of step d).

10. The method of claim 9 and further including before step e) the further step of adding cooking oil to the mixture of claim 9.

* * * * *